US007048432B2

(12) United States Patent
Phillippi et al.

(10) Patent No.: US 7,048,432 B2
(45) Date of Patent: May 23, 2006

(54) METHOD AND APPARATUS FOR HYDRATING A GEL FOR USE IN A SUBTERRANEAN FORMATION

(75) Inventors: Max L. Phillippi, Duncan, OK (US); Billy Slabaugh, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 232 days.

(21) Appl. No.: 10/464,923

(22) Filed: Jun. 19, 2003

(65) Prior Publication Data

US 2004/0256106 A1 Dec. 23, 2004

(51) Int. Cl.
*B01F 15/00* (2006.01)

(52) U.S. Cl. ..... 366/164.1

(58) Field of Classification Search ..... 366/164.6, 366/164.5, 164.4, 164.3, 164.2, 164.1, 165.3, 366/165.1, 131
See application file for complete search history.

(56) References Cited

U.S. PATENT DOCUMENTS

| | | | | | |
|---|---|---|---|---|---|
| 1,496,345 | A | * | 6/1924 | Lichtenhaeler | 366/165.2 |
| 2,531,760 | A | | 11/1950 | Woolsey | 229/24 |
| 2,768,123 | A | * | 10/1956 | Trusty et al. | 366/173.1 |
| 3,332,442 | A | * | 7/1967 | Reed | 366/167.1 |
| 3,744,765 | A | | 7/1973 | Bard | 259/96 |
| 3,923,289 | A | * | 12/1975 | Danberg | 366/164.6 |
| 4,175,873 | A | * | 11/1979 | Iwako et al. | 366/165.3 |
| 4,239,396 | A | | 12/1980 | Arribau et al. | 366/2 |
| 4,336,145 | A | | 6/1982 | Briscoe | 252/8.55 |
| 4,511,256 | A | * | 4/1985 | Karg et al. | 366/165.3 |
| 4,529,321 | A | * | 7/1985 | Berchoux | 366/177.1 |
| 4,640,622 | A | * | 2/1987 | Sortwell | 366/164.6 |
| 4,722,646 | A | | 2/1988 | McIntyre | 410/138 |
| 4,828,034 | A | | 5/1989 | Constien et al. | 166/308 |
| 4,845,192 | A | | 7/1989 | Sortwell et al. | 528/499 |
| 5,026,168 | A | | 6/1991 | Berryman et al. | 366/168 |
| 5,071,257 | A | | 12/1991 | Hasenpath et al. | 366/169 |
| 5,190,374 | A | | 3/1993 | Harms et al. | 366/165 |

(Continued)

FOREIGN PATENT DOCUMENTS

DE 42 17 373 A1 12/1993

(Continued)

OTHER PUBLICATIONS

Foreign communication from a related counterpart application dated Oct. 13, 2004, 17 pages.

*Primary Examiner*—Tony G. Soohoo
(74) *Attorney, Agent, or Firm*—Robert A. Kent; Crutsinger & Booth

(57) ABSTRACT

The present invention relates to a method and system for hydrating a gel for treating a wellbore penetrating a subterranean formation. The method includes directing a base fluid through an inlet into a mixer having an inner chamber housing a plurality of impellers extending radially from and rotating about a hub, causing a centrifugal motion of the base fluid, feeding a quantity of gel into the mixer, mixing the gel with the base fluid and discharging the now-hydrated gel from the inner chamber through an outlet of the mixer. A prewetting device may also be used. Thereafter, a variety of additives may be added to the gel fluid mix to form a fluid treatment to be introduced into a subterranean formation.

11 Claims, 7 Drawing Sheets

U.S. PATENT DOCUMENTS

| | | | | |
|---|---|---|---|---|
| 5,344,619 | A * | 9/1994 | Larwick et al. | 366/164.6 |
| 5,382,411 | A | 1/1995 | Allen | 422/131 |
| 5,664,733 | A | 9/1997 | Lott | 239/429 |
| 2004/0218463 | A1* | 11/2004 | Allen | 366/164.6 |
| 2004/0218464 | A1* | 11/2004 | Arribau et al. | 366/164.6 |

FOREIGN PATENT DOCUMENTS

| | | | |
|---|---|---|---|
| EP | 0 508 817 | A1 | 10/1992 |
| EP | 1 398 459 | A2 | 3/1994 |
| EP | 0 665 050 | A1 | 8/1995 |
| WO | WO 2004/007894 | A2 | 1/2004 |

* cited by examiner

METHOD AND APPARATUS FOR HYDRATING A GEL FOR USE IN A SUBTERRANEAN FORMATION

FIELD OF THE INVENTION

The present invention relates to mixing of a gel agent and hydrating agent to form a hydrated gel, such as a hydrated fracturing gel or other similar gel, and more particularly, to a method and system for more efficiently hydrating such gels without the formation of unwanted gel clumps.

BACKGROUND OF THE INVENTION

Many treatments and procedures are carried out in the oil industry utilizing high viscosity fluids to accomplish a number of purposes. For example, in the oil industry, high viscosity aqueous well treating fluids or gels are utilized in treatments to increase the recovery of hydrocarbons from subterranean formations, such as by creating fractures in the formation. High viscosity aqueous fluids are also commonly utilized in well completion procedures. For example, during the completion of a well, a high viscosity aqueous completion fluid having a high density is introduced into the well to maintain hydrostatic pressure on the formation which is higher than the pressure exerted by the fluids contained in the formation, thereby preventing the formation fluids from flowing into the wellbore. High viscosity treating fluids, such as fracturing gels, are normally made using dry gel additives or agents which are mixed with water or other aqueous fluids at the job site. Such mixing procedures have some inherent problems, particularly on remote sites or when large volumes are required. For example, special equipment for mixing the dry additives with water is required, and problems such as chemical dusting, uneven mixing, and lumping result. The lumping of gels occurs because the initial contact of the gel with water results in a very rapid hydration of the outer layer of particles which creates a sticky, rubbery exterior layer that prevents the interior particles from contacting water. The net effect is formation of what are referred to as "gel balls" or "fish eyes". These hamper efficiency by lowering the viscosity achieved per pound of gelling agent and also by creating insoluble particles that can restrict flow both into the well formation and back out of it. Thus, simply mixing the untreated gel directly with water is not a very successful method of preparing a smooth homogeneous gel free from lumps.

A method directed to solving this problem is to control particle size and provide surface treatment modifications to the gel. It is desired to delay hydration long enough for the individual gel particles to disperse and become surrounded by water so that no dry particles are trapped inside a gelled coating. This can be achieved by coating the gel with materials such as borate salts, glyoxal, non-lumping HEC, sulfosuccinate, metallic soaps, surfactants, or other materials of opposite surface charge to the gel. A stabilized gel slurry (SPS), also referred to as a liquid gel concentrate (LGC), is the most common way to improve the efficiency of a gel addition to water and derive the maximum yield from the gel. The liquid gel concentrate is premixed and then later added to the water. In U.S. Pat. No. 4,336,145 to Briscoe, assigned to the assignee of the present invention and incorporated herein for all purposes, a liquid gel concentrate is disclosed comprising water, the gel, and an inhibitor having the property of reversibly reacting with the hydratable gel in a manner wherein the rate of hydration of the gel is retarded.

Upon a change in the pH condition of the concentrate such as by dilution or the addition of a buffering agent to the concentrate, upon increasing the temperature of the concentrate, or upon a change of other selected condition of the concentrate, the inhibition reaction is reversed, and the gel or gels hydrate to yield the desired viscosified fluid. This reversal of the inhibition of the hydration of the gelling agent in the concentrate may be carried out directly in the concentrate or later when the concentrate is combined with additional water. The aqueous-based liquid gel concentrate of Briscoe has worked well at eliminating gel balls and is still in routine use in the industry. However, aqueous concentrates can suspend only a limited quantity of gel due to the physical swelling and viscosification that occurs in a water-based medium. Typically about 0.8 pounds of gel can be suspended per gallon of the concentrate.

To solve this problem, a hydrocarbon carrier fluid is used, rather than water, so higher quantities of solids can be suspended. For example, up to about five pounds per gallon of gel may be suspended in a diesel fuel carrier. Such a liquid gel concentrate is disclosed in U.S. Pat. No. 4,722,646 to Harms and Norman, assigned to the assignee of the present invention and incorporated herein for all purposes. Such hydrocarbon-based liquid gel concentrates work well but require a suspension agent such as an organophylic clay or certain polyacrylate agents. The hydrocarbon-based liquid gel concentrate is later mixed with water in a manner similar to that for aqueous-based liquid gel concentrates to yield a viscosified fluid, but hydrocarbon-based concentrates have the advantage of holding more gel.

A problem with prior methods using liquid gel concentrates occurs in offshore situations. The service vessels utilized to supply the offshore locations have a limited storage capacity and must, therefore, often return to port for more concentrate before they are able to do additional jobs, even when the liquid gel concentrate is hydrocarbon-based. Therefore, it would be desirable to be able to mix a well treatment gel on-demand during the treatment of the subterranean formation from dry ingredients. For example, such an on-line system could satisfy the fluid flow requirements for large hydraulic fracturing jobs during the fracturing of the subterranean formation by mixing the fracturing gel on demand.

One method and system for on-demand mixing of a fracturing gel is disclosed in U.S. Pat. No. 4,828,034 to Constien et al., herein incorporated by reference, in which a fracturing fluid slurry concentrate is mixed through a static mixer device on a real-time basis to produce a fully hydrated fracturing fluid during the fracturing operation. This process utilizes a hydrophobic solvent, which is characterized by a hydrocarbon such as diesel as in the hydrocarbon-based liquid gel concentrates described above. Such a slurry concentrate typically involves a gel slurry wherein a hydratable gel is dispersed in a hydrophobic solvent in combination with a suspension agent and a surfactant with or without other optional additives commonly employed in well treatment applications. Because of the inherent dispersion of the hydratable gel in the oil-based fluid (i.e., lack of affinity for each other), such fracturing fluid slurry concentrates tend to eliminate lumping and premature gelation problems and tend to optimize initial dispersion when added to water. However, most recently, there have been some problems with hydrocarbon-based liquid gel concentrates because some well operators object to the presence of these fluids, such as diesel, even though the hydrocarbon represents a relatively small amount of the total fracturing gel once mixed with water. And, there are environmental problems associated with the clean-up and disposal of well treatment gels containing hydrocarbons. Also, diesel, surfactants, suspension agents and other additives increase the cost of the well treatment fluid, not to mention the cost to transport these materials to and from the well site. These hydrocarbon-related problems would also apply to the process of Constien.

Another problem associated with some prior art methods for hydrating gels is that the gelling agent must subsequently be mixed in holding tanks for a considerable length of time for hydration of the gelling agent to occur, especially in the use of water-based fracturing fluids including a gelled and cross-linked polysacharade gelling agent.

Accordingly, there is a need for an on-demand process to eliminate the environmental problems and objections related to hydrocarbon-based concentrates and provide for more efficient methods whereby the treating fluids do not have to employ hydrocarbon-based concentrates such as LGCs to prepare treating fluids.

U.S. Pat. No. 5,190,374, to Harms et al., which is incorporated herein by reference thereto for purposes of disclosure, assigned to the assignee of the present invention, discloses method and apparatus for substantially continuously producing a fracturing gel, without the use of hydrocarbons or suspension agents, by feeding the dry polymer into an axial flow mixer which uses a high mixing energy to wet the polymer during its initial contact with water. After initial mixing, the additional water may be added to the mixer to increase the volume of water-polymer slurry produced thereby. In Harms, a predetermined quantity of hydratable polymer in a substantially particulate form is provided to a polymer or solids inlet of a water spraying mixer. A stream of water is supplied to a water inlet of the mixer, and the water and polymer are mixed in the mixer to form a water-polymer mix prior to discharge from the mixer. The mixer is preferably mounted adjacent to the upper portion of a mixing or primary tank, and an agitator may be provided in the mixing tank to further agitate and stir the slurry. The slurry may be transferred from the mixing tank to a holding or secondary tank after which it is discharged to the fracturing process. A high shear device may be disposed in the holding tank. A pump may be used for transferring the slurry from the mixing tank to the holding tank.

Although Harms discloses an on-line mixing system which may be used with untreated and uncoated polymers, in practice there are problems with the Harms mixing system. For example, the powder splatters inside the mixer, sticks to the walls of the mixer, and builds up, eventually choking flow through the mixer. The sequential opening of the water orifices in sets of six orifices inadequately wets the powder at low flow rates, and allows unwetted powder to pass. Another problem is created by the entrainment of air in the fluid mixed in the mixer which impairs the ability of the pump to adequately pump the mixture from the mixer. Another problem is the creation of additional discharge of the pump into the holding tank. The entrained air compels the use of deaerating chemicals with the system. Another problem is the lack of a controlled flow path and, therefore, the hydration time in the holding tank, i.e., the hydrating slurry can create unpredictable flow channels through the tank which cause non-uniform residence times of portions of the slurry in the tank. Another problem is the large lag time (5–10 minutes) involved in changing the viscosity of the gel discharged from the holding tank, i.e., the only way to alter the viscosity of the gel is to change the powder/water ratio at the mixer and, therefore, the fluid of "altered" viscosity must displace all of the fluid and gel between the mixer and the outlet of the holding tank before the viscosity at the outlet of the holding tank is altered.

An apparatus and method for continuously hydrating a particulated polymer and producing a well treatment gel is described in U.S. Pat. No. 5,382,411 to Allen and is incorporated herein by reference for all purposes. In Allen, a mixer is employed to spray the polymer with water at a substantially constant water velocity and spray pattern at various rates of water flow. A centrifugal diffuser receives the mixture and passively converts the motion of the mixture thereby separating air from the mixture.

SUMMARY OF THE INVENTION

Presented is an apparatus and method for substantially hydrating a gel particulate for use in a subterranean well. The apparatus has a mixer with a housing defining an inner chamber. A base fluid and a gel particulate are directed into the mixer through inlets for creating a substantially hydrated gel free of unwanted gel clumps or fish-eyes. The mixer has an impeller with a plurality of impeller blades rotating about a hub. Preferably, the gel particulate is axially fed into the mixer from directly above the hub. Additional base fluid inlets, a prewetting device, a metered gel particulate feeder and treating agents can be used. The substantially hydrated gel is discharged from the mixer.

BRIEF DESCRIPTION OF THE DRAWINGS

The accompanying drawings are incorporated into and form a part of the specification to illustrate several examples of the present invention. These drawings together with the description serve to explain the principles of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

Prior Art

DESCRIPTION OF PREFERRED EMBODIMENTS

Figure 1:
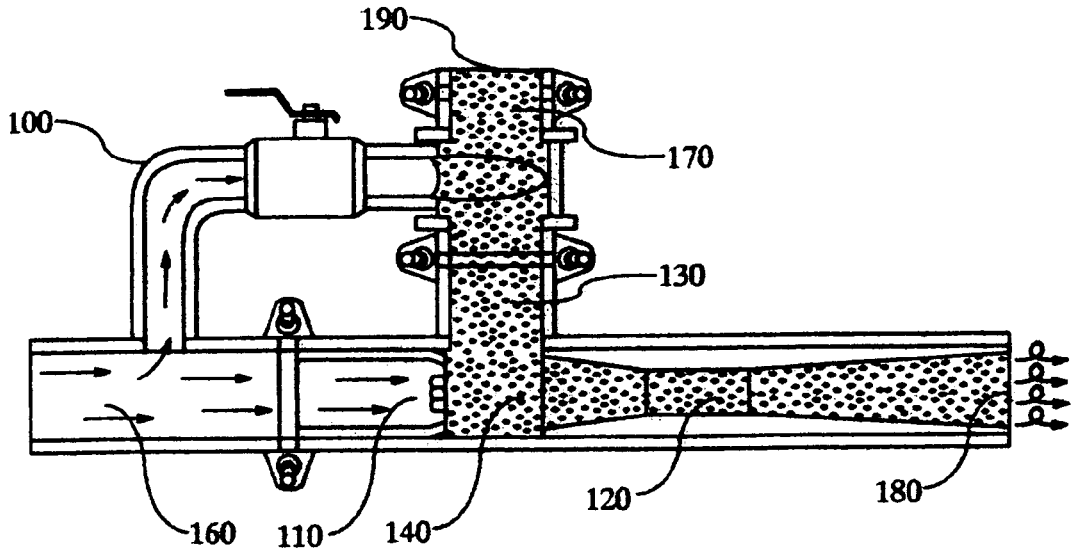
FIG. 1 PRIOR ART
FIG. 1 illustrates a cross-sectional side view of a conventional eductor used to mix and hydrate a gel off site of a wellbore.

The present invention is useful to produce a gel fluid mix for use in fracturing a subterranean formation, while avoiding the formation of gel balls and fish eyes. In the prior art, because gels have a fixed hydration rate at a given temperature, the gels were unable to be thoroughly mixed without the use of materials to slow the gel hydration rate to allow sufficient time for the gel particle dispersion and prevent gel ball or fish eye formation. As mentioned above, such materials include surfactants, suspension agents, liquid gel concentrates, and hydration-delaying coatings. In the present invention, it is possible to use a non-coated (non-surface-treated) particulated gelling agent to form a gel fluid mix. This provides a simpler and less expensive process, and the materials themselves are also cheaper because raw gelling agents are less expensive than coated or treated materials.

The present inventions are described by references to drawings showing one or more examples of how the inventions can be made and used. In these drawings, reference characters are used throughout the several views to indicate like or corresponding parts.

Turning initially to Prior Art FIG. 1, illustrated is a cross-sectional side view of a conventional eductor used to mix and hydrate gel powders with a base fluid off site of a wellbore. Eductors of the prior art for mixing and hydrating gels provide a jet pump without moving parts and utilize fluid in motion to produce low pressure. The four basic parts of the eductor used to conventionally mix a gel are a jet nozzle 110, a diffuser 120, a suction port 130, and a mixing chamber 140. A pressurized fluid stream is converted from pressure-energy to high velocity as the fluid enters a nozzle. The issuing high velocity jet stream produces a strong suction in the mixing chamber 140 of the eductor 100, causing a particulated gel powder 170 to be drawn through a suction port 130 into the mixing chamber 140. A gel powder supply 190 is positioned to supply the gel powder 170 to the educator 100. An exchange of momentum occurs when the powder intersects with the moving base fluid 160. The dynamic turbulence between the two components produces a uniformly mixed stream of base fluid traveling at a velocity intermediate between the high velocity base fluid and suction velocities through a constant diameter throat, where mixing is completed and the blended mixture is discharged through a discharge port 180. The diffuser 120 is shaped to reduce the velocity of the fluid gradually and convert velocity energy back to pressure as it is discharged through port 180.

The mixing effectiveness of the eductor 100 depends on the flow rate of the aqueous base fluid 160 and the amount of gel powder provided in the suction port 130. Thus, the eductor 100 of the prior art must maintain a constant flow rate to sustain optimum mixing effectiveness. If the flow rate of the base fluid or gel powder is varied, reduced mixing effectiveness results. One skilled in the art appreciates that for a nozzle configured for an optimum flow rate of 200 gallons/minute, the nozzle will not mix effectively at a flow rate of 300 gallons/minute or 100 gallons/minute. This decrease in mixing effectiveness results because the shear energy used to mix the gel powder and base fluid will vary as a function of base fluid flow rate and gel powder input rate. Therefore, eductors such as eductor 100 cannot be used to mix and hydrate gels on-demand at a wellbore site. Instead, other methods have been developed to mix and hydrate gel fluids allowing for such changes on the fly. Such methods entail the use of liquid gel concentrates to disperse the gel particles in a blending tank.

Figure 2A:
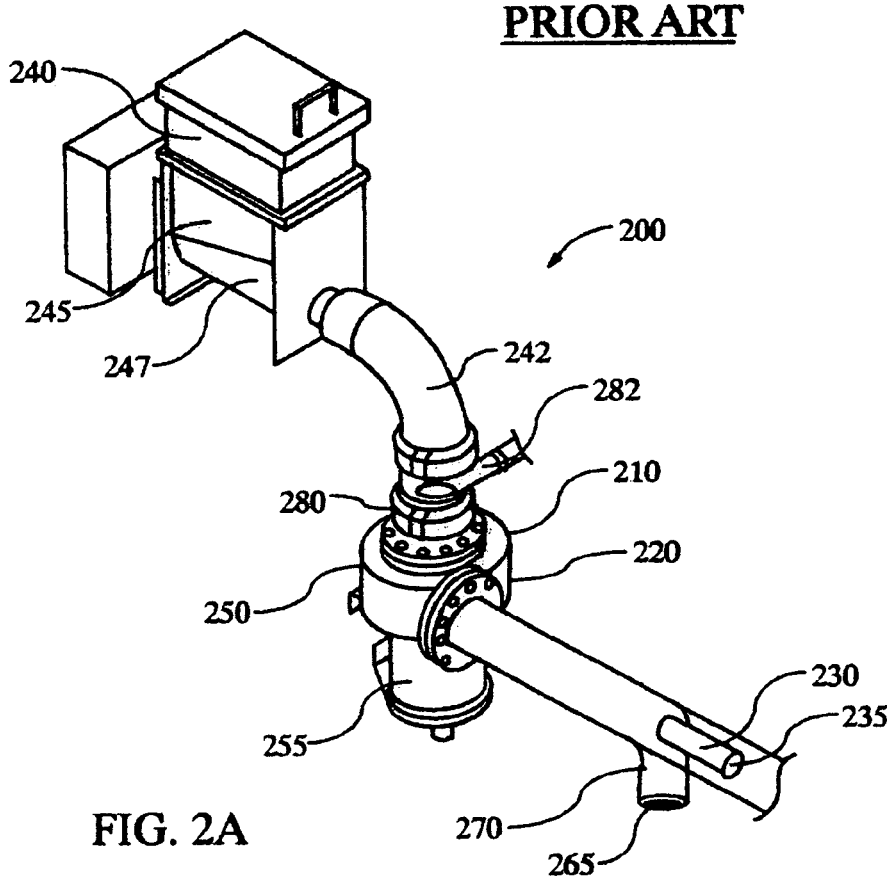
FIG. 2A illustrates an orthogonal view of an embodiment of the system.
Figure 2B:
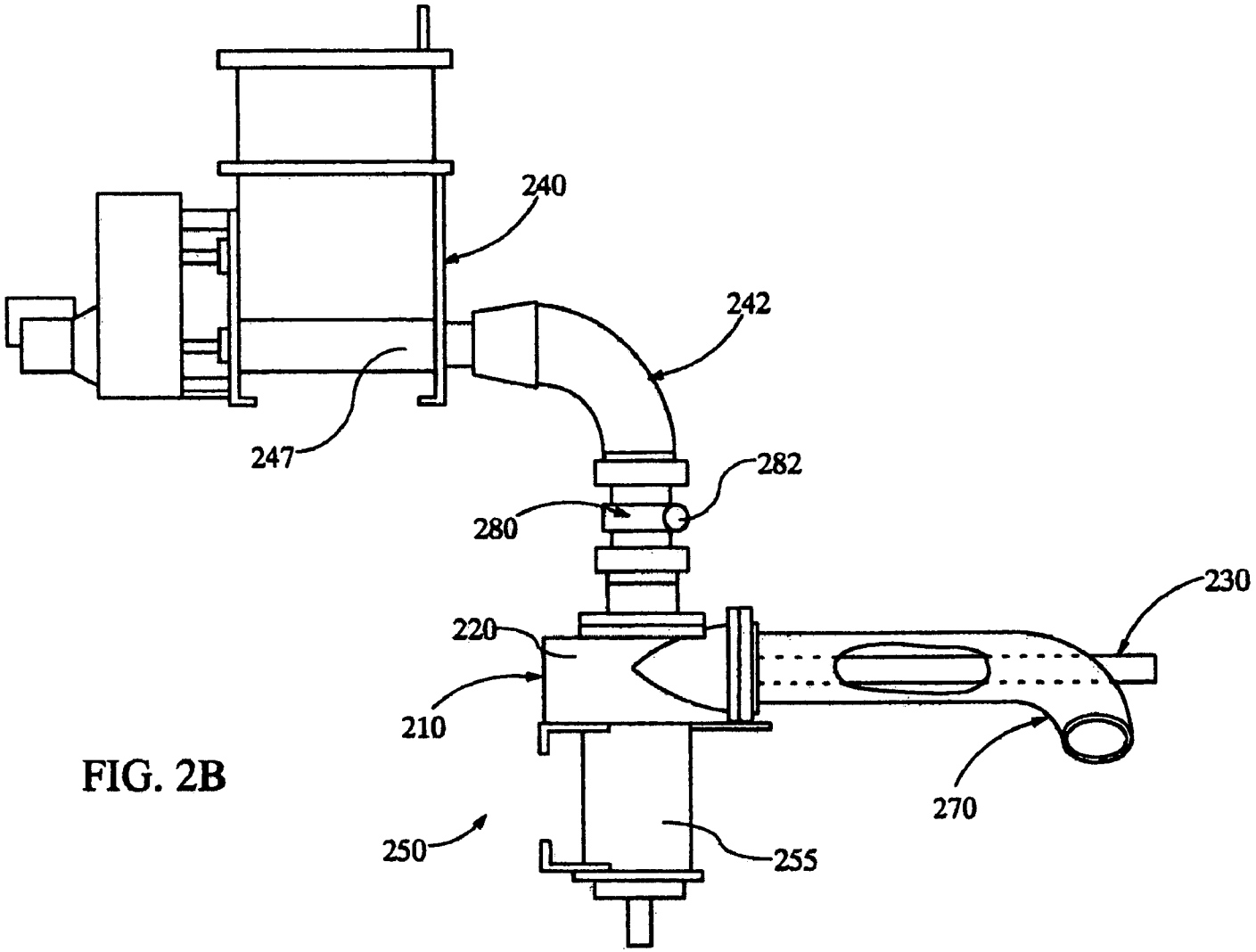
FIG. 2B illustrates an elevational view of one embodiment of the system with cutaway.

Turning to FIGS. 2A and B, an embodiment of a system 200 according to the principles of the present invention is illustrated. The system 200 includes a gel powder supply 240 connected to a mixer 250. A base fluid 235, such as water, is supplied to the mixer 250 by fluid inlet 230, and the mixed gel 25 is directed through outlet 270.

The mixer 250 includes a housing 210 having an inner chamber 220. The mixer 250 is powered by a power source 255 such as a motor. The mixer 250 is fed the powdered gel 245 by the gel powder supply 240 through the powder inlet 242. The mixer 250 creates a suction, when in use, and draws the powdered gel 245 through the inlet 242 and into the mixing chamber 220. A base fluid 235 is supplied to the mixer 250 through a base fluid inlet 230. The base fluid may be comprised of various fluids, but is preferably water based. The mixer employs an impeller 215 rotating on a hub 260 which spins on an axis, such as in a centrifugal pump, creating a centrifugal motion in the gel powder and base fluid. The mixer 250 efficiently mixes the powdered gel 245 and base fluid 235 to create a hydrated gel fluid 265 which is directed from the mixer through outlet 270. The resulting gel fluid mix 265 may be further processed as desired, such as by the use of diffusers, separators, hydration tanks and the like.

The energy for mixing the powdered gel and base fluid is provided by the motive force of the moving parts of the mixer, which contact and move the gel powder and base fluid, creating a vortex. Unlike in prior art educators, the energy for mixing is not supplied by a change in fluid velocity and pressure. Thus, the present system advantageously allows greater variations in flow rate of the base fluid and powdered gel on-the-fly or on-demand. Obviously, there are limits to the range of rates which any impeller mixer may be efficiently operated. At some flow rate, the centrifugal energy of the mixer is overwhelmed. While servicing a well with a gel, it is typical to place the hydrated gel into the well at widely varying rates. For example, a high flow rate, say 50 barrels per minute, may be needed initially. Once the operation is in full-swing or nearing completion, the necessary rate may taper off, often substantially, to about 2 barrels per minute. The present invention will allow production of hydrated gel over a wide range of rates as needed. This will reduce or eliminate the need for filling large storage tanks with hydrated gel prior to the start of servicing the well.

The powder supply 240 may be of a type that discharges an accurately metered quantity of gel over time. A metering feeder 247 may be provided and may include a large conditioning auger or agitator to "condition" or stir the dry powder and break up any clumps of gel powder that might be stuck together. The metering feeder 247 is an Acrison (a registered trademark) feeder, which is commercially available; however, the present invention is not intended to be limited to this particular metering feeder as long as the feeder may be used to provide an accurately metered quantity of dry powder discharged therefrom.

The system 200 may also include a prewetting device 280 connected between the mixer 250 and powder supply 240 to further prevent clumping of the gel powder. The prewetting device 280 includes an inlet 282 to introduce prewetting fluid into the prewetting device and is fluidly connected to the powder inlet 242 and the inner chamber 220 of the mixer 250. The prewetting device 280 both prewets the powder and provides an additional source of fluid to wet the impellers and other parts of the mixer. In one embodiment, the prewetting device 280 may include a nozzle that is configured to produce vortex induction and chaotic turbulent flow of the prewetting fluid, thereby wetting at least a portion of the one or more impellers with the wetting fluid. A description of embodiment of the prewetting device 280 is presented in U.S. Pat. No. 5,664,733, which is incorporated herein by reference.

Another example of a prewetting device 280 that may be used to prewet at least a portion of the one or more impellers is a radial premixer, or "annular jet pump." When using a radial premixer as the prewetting device 280, pressurized fluid creates a vortex. Powdered materials are introduced into the eye of the vortex of prewetting fluid. As the gel particles are absorbed into the prewetting fluid, a centrifugal force moves the mixture outward from the vortex axis, providing distance between the gel particles as the wetting-out process develops. The gel particle spreading caused by the centrifugal action of the radial premixer reduces particle adhesion and clumping. Thus, the radial premixer 280 works not only to prewet at least a portion of the one or more impellers with prewetting fluid, it also works to wet the gel particles before the gel particles contact the base fluid and one or more impellers of the mixer 250. It will be understood by those skilled in the art that various prewetting devices may be effectively employed.

As mentioned above, the prewetting fluid and base fluid may be selected from a number of fluids to mix with the gel powder such as condensate, diesel or water such as fresh water, unsaturated salt water, brines, seawater or saturated sea water. A valve means (not shown) may be operatively connected to the prewetting device 280 to control the prewetting fluid that enters the prewetter. Similarly, a valve means (not shown) may be operatively connected to the inlet 230 to control the flow of base fluid entering the inner chamber 220. Further, a feedback sensor and computer may be used to control the valve means for the prewetting device 280 and the inlet 230. Similarly, a feedback and control mechanism may be used to control the feeder 240.

Figure 3A:
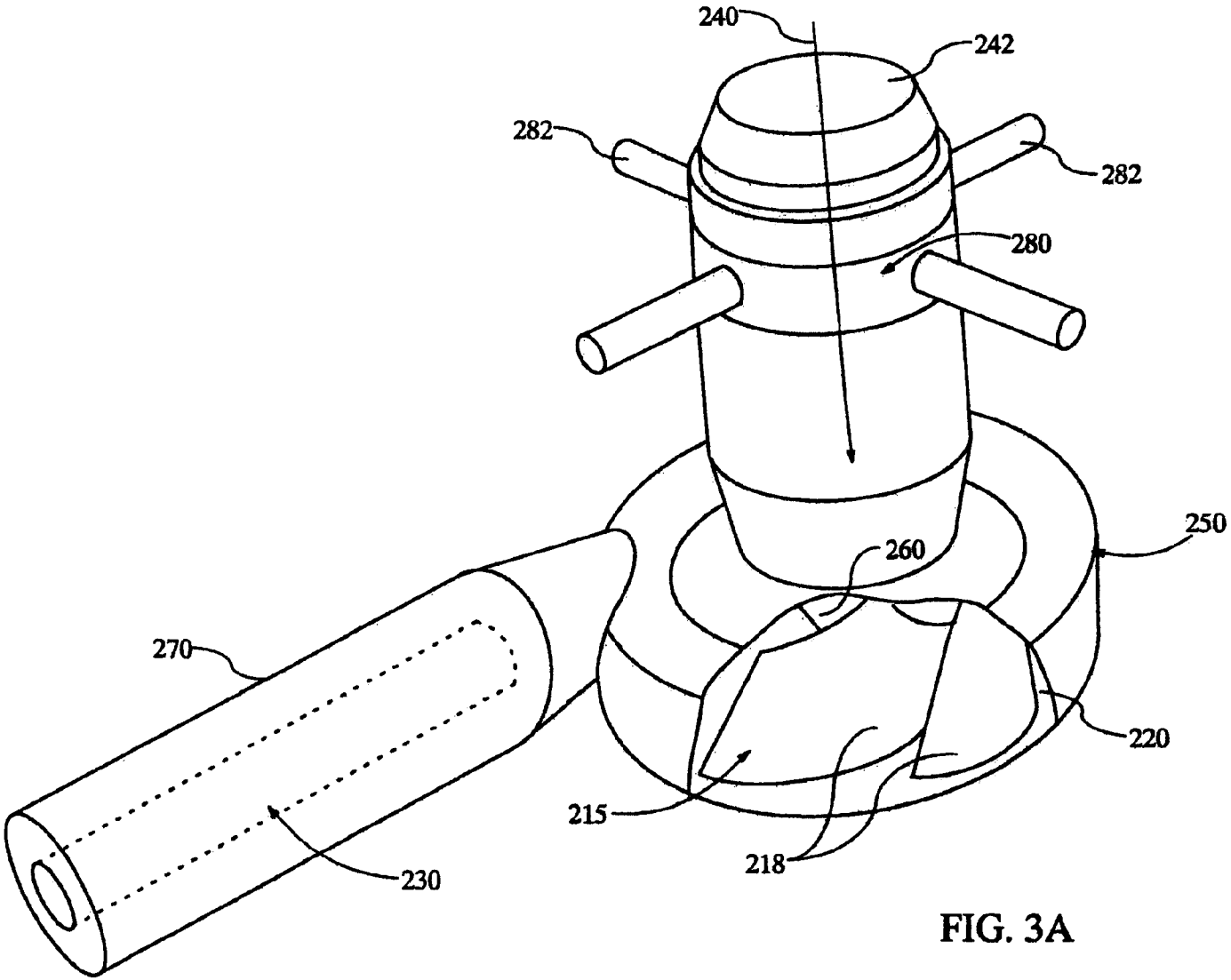
FIG. 3A illustrates an enlarged schematic side view of one embodiment of a partially-completed system in accordance with the present invention, which includes a centrifugal pump.

FIGS. 3A and B are detail views of a typical centrifugal pump used as mixer 250 with a base fluid inlet 230, leading to inner chamber 220. The impeller 215 has a hub 260 about which a plurality of impeller blades 218 rotate thereby directing fluid flow. Gel powder 245 is introduced into the inner chamber 220 through powder inlet 242. The gel may be a dry powder or a powder which has been prewetted. Although rotation of the impeller creates a mild suction at the powder inlet 242, the powder is fed into the mixer 250 primarily by gravity. The impeller 215 mixes the gel powder 245 and base fluid 235 to form a gel fluid mix 265 or hydrated gel without the formation of unwanted gel balls or clamps. In use, the centrifugal pump 250 establishes a fluid flow through base fluid inlet 230 into the impeller 215 and then out through gel fluid mix outlet 270.

Figure 3B:
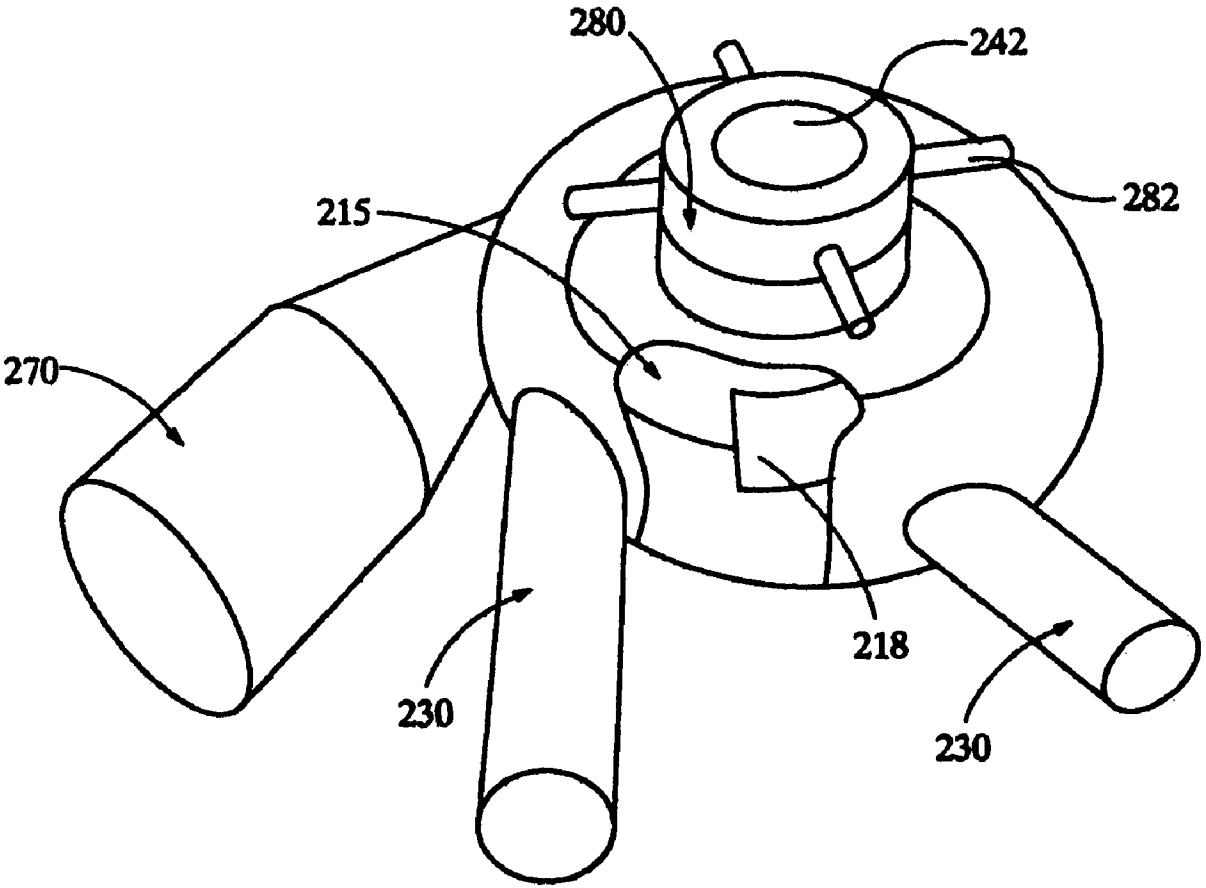
FIG. 3B shows another mixer embodiment of the present invention.

In FIG. 3B, another mixer embodiment is presented. In FIG. 3A, the base fluid inlet 230 housed at least partially by and extends through the hydrated gel outlet 270. In FIG. 3B, the base fluid inlet 230 attaches to the mixer 250 at a location separate from the point of attachment of the hydrated gel outlet 270 to the mixer 250, allowing a larger through-put of base fluid and mixture. FIGS. 3A and B illustrate two possible arrangements for the inlet 230 and outlet 270, but other configurations may be used. The mixer, inlet and outlet size may be chosen to suit the needs of a particular job.

The mixer 250 is preferably a centrifugal pump mounted vertically with the pump inlet facing upward. The normal water inlet of the pump is used as the powder inlet 242. Optionally, a second base fluid inlet 232 can be employed. Preferably the inlets 230 and 232 and mixture outlet 270 attach to the mixer at an oblique angle, as shown.

While the improved method and system of this invention can be utilized in a variety of subterranean well treatments such as fracturing subterranean formations, forming gravel packs in subterranean formations, forming temporary blocking in the wellbore, and as completion fluids and drill-in fluids, it is particularly useful in fracturing fluids for producing one or more fractures in a subterranean formation. When utilized as a fracturing fluid, a cross-linking agent and a proppant material is generally mixed with the gel fluid to form a gel treatment fluid. For example, gel fluid mix can be flowed from the mixer 250 to a holding tank to a fracturing blender, which mixes sand, proppants and cross-linkers with the gel fluid mix. Other agents, liquid or solid, can be used to treat the gel mixture as desired. The gel fluid mix may be discharged into a tank and then agitated in the tank before or after being combined with such well treatment materials. Such downstream devices 600 are known in the art and will not be described in detail here.

The system 200 may also include a temperature gauge to control the temperature of the base fluid. The temperature gauge may be controlled by a feedback mechanism. Because the rate of hydration is effected by temperature, increasing temperature could be used to increase the rate of hydration of the gel agent. More importantly, the temperature gauge may be used to adjust the temperature specific to the wellbore. For example, some wellbores must be treated with fracturing fluids that are heated up to 120° F., and others with fracturing fluids that are set at a temperature of 60° F. Conventionally, the gel fluid temperature is controlled later in the process of producing a well treatment fluid in a blending tank by running the treatment fluid through a boiler to warm the well treatment fluid to the desired temperature of the wellbore. The hydration rate is affected by the temperature of the base fluid. Higher temperatures result in faster hydration. It may be desirable to use hotter base fluid, up to near the boiling point, to increase the hydration rate of the gel in the mixer. Since the primary flow of base fluid is typically not directed through the mixer, increasing the hydration rate at the mixer may increase the hydration rate of an overall hydration system, as for example, that seen in FIG. 6.

Figure 4:
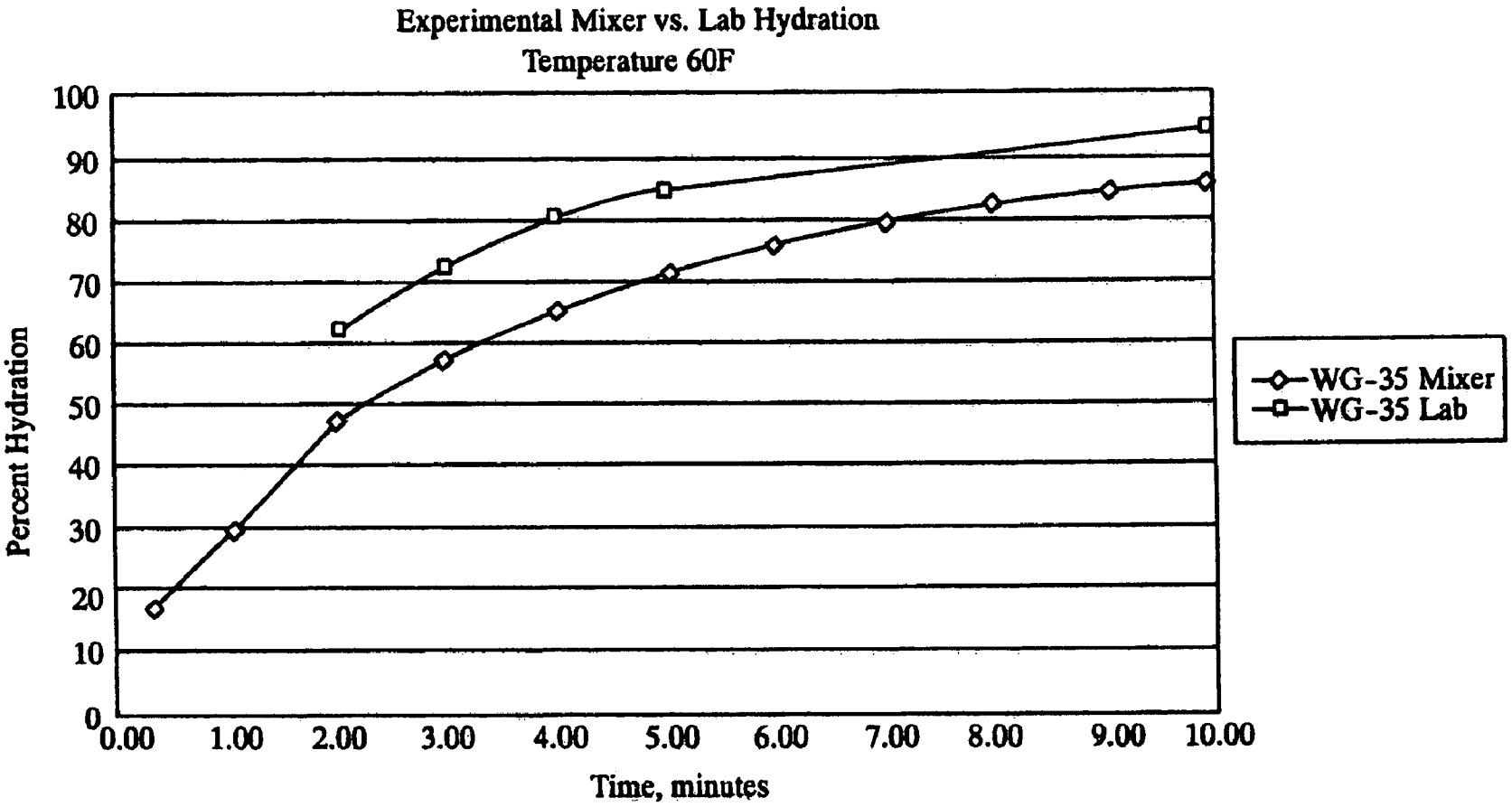
FIG. 4 is a graphical plot of time, measured in minutes, versus the percent hydration for one gel type hydrated using different mixers.

Turning now to FIG. 4, illustrated is a plot of the time, measured in minutes, versus the percent hydration for a gel powder in 60° F. fluid. This plot compares hydration of a gel with a standard wearing blender in a lab and hydration in the system of the present invention. FIG. 4 shows that the lab blender hydrated faster than the mixing system of the present invention. These results indicate that the system of the present invention does not increase the hydration rate of the gel. Thus, the present invention effectively mixes the gel with base fluid, thereby avoiding the formation of gel balls and fish eyes, but the system of the present invention does not speed the rate of hydration, or the rate that the gel becomes intimately bound to or absorbs the aqueous base fluid. The present invention, as mentioned above, merely speeds the rate of mixing, or the dispersion rate of the gel particles in the base fluid, so as to avoid the formation of gel balls and fish eyes.

The rate of hydration of the gel is still a critical factor, particularly in continuous mix applications wherein the necessary hydration and associated viscosity rise must take place over a relatively short time span corresponding to the residence time of the fluids during the continuous mix procedure. In such applications, hydration is the process by which the hydratable gel absorbs fluid or becomes intimately bound to a fluid. Once the gel is dispersed, its ability to absorb fluid will dictate hydration rate. Several factors will determine how readily the gel will hydrate or develop viscosity such as pH, the level of mechanical shear in the initial mixing phase, and salt concentration and type in the solution. Finally, the extent of retardation of hydration rate is a function of polymer concentration. These principles of retarding hydration rate may be used in conjunction with the present invention to retard hydration rate of a rapidly hydrating gel. It is contemplated that such materials may be added to the gel fluid mix to retard hydration as well as use the principles of the present invention to thoroughly mix the gel prior to hydration. Conversely, the present invention also provides for a system and method of mixing or dispersing the gel particles in order to thoroughly mix the gel, without the use of pH adjusters, salts and additional mechanical shear applied to the system 200.

Figure 5:
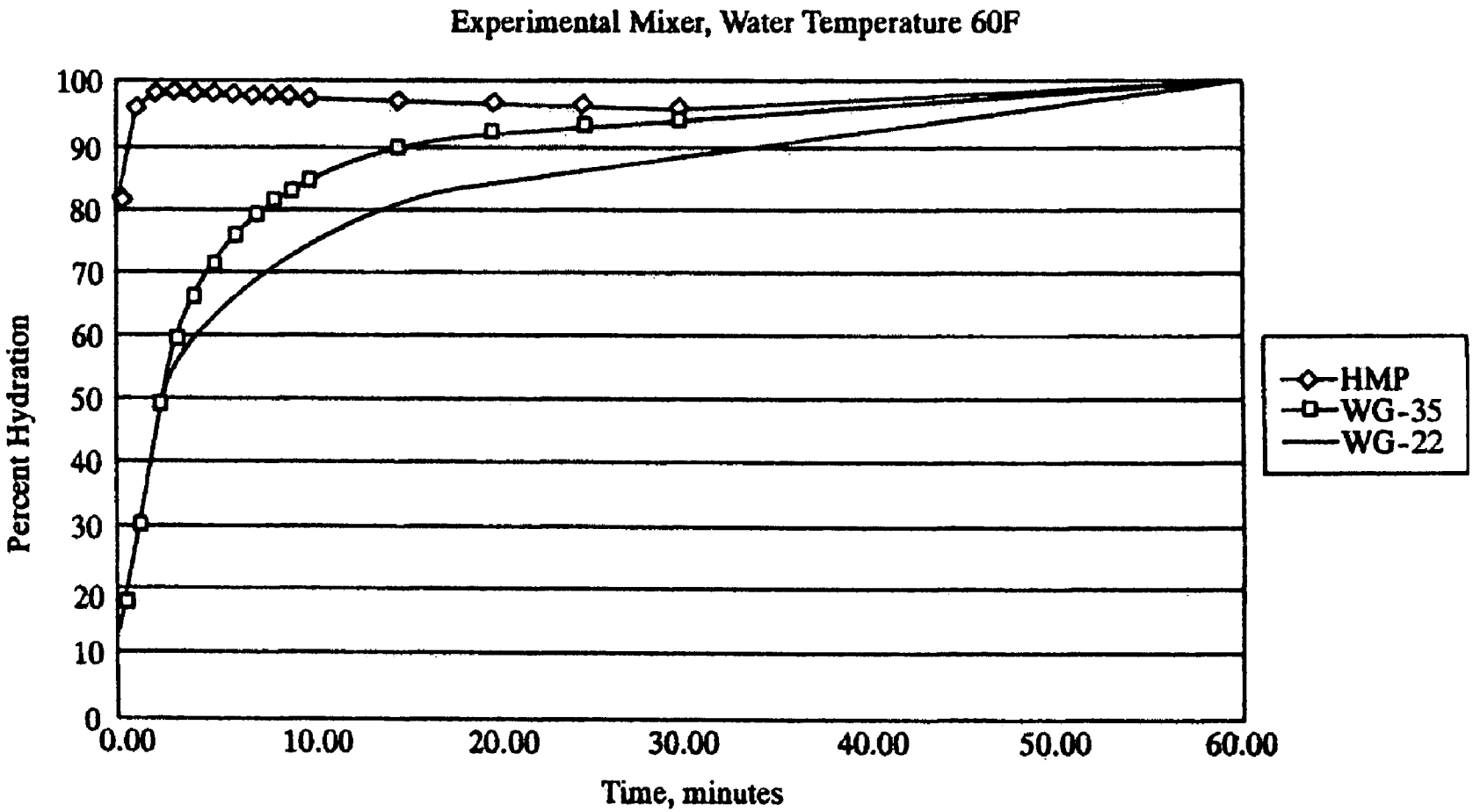
FIG. 5 is a graphical plot of time, measured in minutes, versus the percent hydration for multiple gels.

Turning now to FIG. 5, illustrated is a plot of time, measured in minutes, versus the percent hydration for three gels in 60° F. water. The gel agents, the Halliburton Macro Polymer (trademark), or HMP, and the WG-35 and WG-22 gels, have different hydration rates. These gels are exemplary only. The "WG" gels are graded by the viscosity they are designed to produce. The WG-22 produces 22 cp in three minutes at 75° F. Under similar conditions, the WG-35 produces a viscosity of 35 cp. These products are both guars and similar products are commercially available from Rhodia, Inc., Economy (trademark) Polymers, and Benchmark Technologies, Inc. To compare, the HMP was 80% hydrated at half of a minute and 95% hydrated at one minute. The WG-35 gel and the WG-22 gel were both 80% hydrated at ten minutes. The present invention advantageously provides for a method and system of hydrating gels, even traditionally hard-to-mix gels that have a rapid rate of hydration. Once the gel particles for gel balls or fish eyes, thorough mixing of the gel fluid mix is difficult to attain. Such rapidly hydrating gels are still utilized in fracturing processes by employing materials to help delay hydration until gel particle dispersion occurs. These hydration-delaying techniques, as mentioned above, include materials such as surfactants, liquid gel concentrates, and coated gels (surface-treated). The present invention provides a simpler and less expensive process, and the materials themselves are also cheaper because raw gelling agents are less expensive than coated or treated materials. The on-demand system of the present invention may be used in oil field applications and eliminates the use of conventional large volume mixing tanks, yet satisfies the fluid flow requirements for well treatment processes such as large hydraulic fracturing jobs during the actual fracturing of the subterranean formation.

Figure 6:
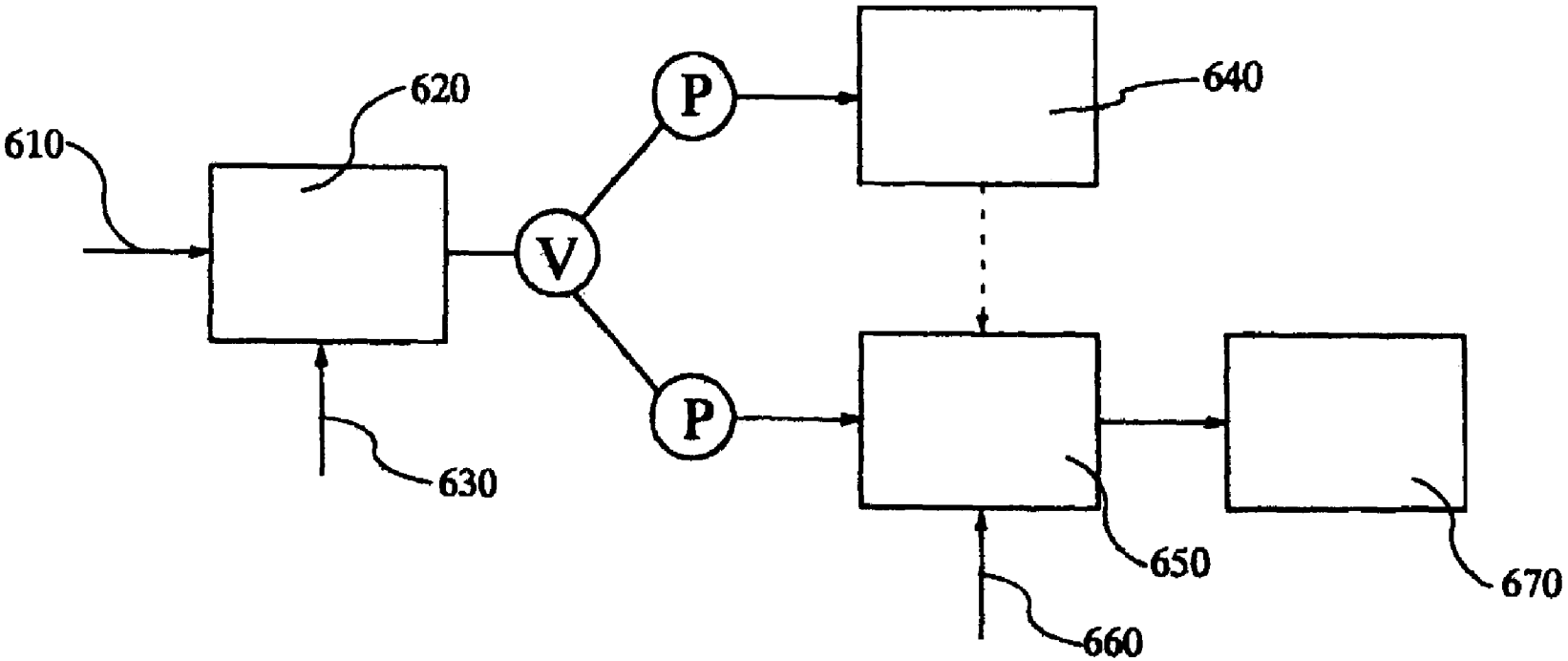
FIG. 6 illustrates a flow diagram of one embodiment of a method of fracturing of a subterranean formation according to the principles of the present invention.

Turning now to FIG. 6, illustrated is one embodiment of a method of fracturing of a subterranean formation according to the principles of the present invention. A base fluid 610 and a powdered gel 630 are directed into the system 620 of the present invention. As mentioned above, the system 620 of the present invention includes an inner chamber of a housing having a plurality of impellers extending radially from and rotating about an axis, thereby causing a centrifugal motion of the base fluid and gel thereby mixing and hydrating the gel.

In the use of water-based fracturing fluids including a slow-hydrating gel, the gelling agent can be discharged from the inner chamber through an outlet of the housing into a holding tank 640, where the gel fluid mix is further blended for hydration of the gelling agent to occur. During the fracturing process carried out in a well, the hydrated fracturing fluid is subsequently pumped out of the holding tanks 640 into a blending tank 650. Thereafter, a variety of additives 660 may be added to the tank 650 of the gel fluid mix to form a fluid treatment. Such additives include pH adjusting compounds, buffers, dispersants, surfactants for preventing the formation of emulsions between the treating fluid formed with the gel fluid mix and subterranean formation fluids, bactericides and the like. Alternatively, in the case of rapidly-hydrating gels, the gel fluid mix is immediately pumped to the blending tank 650 as there is no need to further hydrate a rapidly-hydrating gel. The treatment fluid is then pumped down the wellbore 670 to the formation being fractured at a rate and pressure sufficient to create at least one fracture in the formation. It should be understood by those skilled in the art that the gel fluid mix could also be mixed with proppants, cross linkers and other materials of a fluid treatment on the fly, rather than in a blending tank 650, and then pumped down the wellbore 670 to the formation being fractured. A breaker activator may then be admixed with the gel treatment fluid in the wellbore. In one embodiment of the present invention, a method of separating hydrocarbons from a subterranean formation further includes the step of flowing back hydrocarbons from the formation to complete the fracturing process.

In the case of slower hydrating gels, the gel held in the holding tank 640 for further hydrating must be disposed of when there is rapid shut down caused by reservoir failure or mechanical/equipment failure, which could entail disposing of thousands of gallons of gel fluid mix, which is not only costly, but also environmentally harmful. It becomes apparent why the present invention, which often will not require gel dispersing agents like diesel, is an improvement over earlier systems. Also, the present invention provides for a method of mixing a gel agent that is not rate dependent; thus, the flow rate may be changed as needed at the job site.

After careful consideration of the specific and exemplary embodiments of the present invention described herein, a person of ordinary skill in the art will appreciate that certain modifications, substitutions and other changes may be made without substantially deviating from the principles of the present invention. The detailed description is illustrative, the spirit and scope of the invention being limited only by the appended claims.

What is claimed is:

1. An apparatus for substantially hydrating a gel particulate for use in a subterranean well, the apparatus comprising:

a mixer having a housing defining an inner chamber;

a base fluid inlet connected to the housing and capable of directing a base fluid into the inner chamber of the housing;

a gel particulate inlet connected to the housing and capable of directing a gel particulate into the inner chamber;

an outlet connected to the housing and capable of directing a substantially hydrated gel away from the housing, wherein the base fluid inlet is at least partially inside of the outlet;

an impeller within the housing, the impeller having a plurality of impeller blades extending radially outward from a hub, the impeller blades for rotating about the hub thereby creating a centrifugal flow.

2. The apparatus of claim 1 further comprising a gel particulate feeder connected to the gel particulate inlet for supplying gel particulate to the apparatus.

3. The apparatus of claim 2, the gel particulate feeder further comprising a metering feed system.

4. The apparatus of claim 1, the mixer comprising a centrifugal pump.

5. The apparatus of claim 1, the mixer able to use gravity to draw gel particulate into the mixer.

6. The apparatus of claim 1 further comprising a prewetting device connected to the gel particulate inlet.

7. The apparatus of claim 1 wherein the gel particulate inlet is positioned above the housing during operation of the apparatus.

8. The apparatus of claim 6 wherein the gel particulate inlet is axially aligned with the impeller hub.

9. The apparatus of claim 1 wherein the base fluid inlet is tangentially connected to the housing.

10. The apparatus of claim 1 wherein the base fluid inlet is connected to the side of the housing.

11. The apparatus of claim 1 further comprising another base fluid inlet connected to the housing.

* * * * *